US005184763A

United States Patent [19]

Blaisdell et al.

[11] Patent Number: 5,184,763

[45] Date of Patent: Feb. 9, 1993

[54] MODULAR, FREE MOVEMENT BACKPACK SYSTEM

[76] Inventors: Richard W. Blaisdell, 3012 Fairmount Ave., San Diego, Calif. 92105; David A. Baer, 4251 Felton St., San Diego, Calif. 92104; Shiy P. Singh, 2275 Bratton Valley Rd., Jamal, Calif. 92035

[21] Appl. No.: 776,995

[22] Filed: Oct. 16, 1991

[51] Int. Cl.[5] ..... A45F 3/08

[52] U.S. Cl. ..... 224/211; 224/153; 224/215; 224/262

[58] Field of Search ..... 224/153, 209, 210, 211, 224/213, 215, 216, 261, 262, 202; 403/76, 122, 131, 135, 141, 124, 173; 128/876

[56] References Cited

U.S. PATENT DOCUMENTS

| | | | |
|---|---|---|---|
| 903,682 | 11/1908 | Cumpston | 224/211 X |
| 3,355,075 | 11/1967 | Dean | 224/25 |
| 4,015,759 | 4/1977 | Dreissigacker et al. | 224/25 A |
| 4,189,076 | 2/1980 | Zufioh | 224/211 |
| 4,214,685 | 7/1980 | Pletz | 224/211 |
| 4,303,186 | 10/1981 | Ollinger, IV | 224/211 |
| 4,318,502 | 3/1982 | Lowe et al. | 224/153 |
| 4,356,942 | 11/1982 | Hayes | 224/211 |
| 4,369,903 | 1/1983 | Wilkes | 224/213 |
| 4,434,793 | 3/1984 | Willitz | 128/876 |
| 4,479,595 | 10/1984 | Opsal | 224/211 |
| 4,504,002 | 3/1985 | Hall | 224/211 |
| 4,881,256 | 11/1989 | Malekos | 403/122 X |
| 4,911,346 | 3/1990 | Shallman | 224/211 |
| 4,982,884 | 1/1991 | Wise | 224/211 |

FOREIGN PATENT DOCUMENTS

| | | | |
|---|---|---|---|
| 434336 | 6/1991 | European Pat. Off. | 224/209 |
| 2646594 | 11/1990 | France | 224/202 |
| 49547 | 4/1977 | Japan | 224/215 |
| 2092662 | 8/1982 | United Kingdom | 403/122 |

*Primary Examiner*—Henry J. Recla
*Assistant Examiner*—Glenn T. Barrett

[57] ABSTRACT

A backpack system having upper and lower modules that are connected by a three-axes ball joint assembly. This joint assembly permits free movement of the hips relative to the shoulders in all directions while transmitting the load to the hips.

The backpack system can easily be separated into upper and lower modules which can be worn independently of each other.

5 Claims, 4 Drawing Sheets

MODULAR, FREE MOVEMENT BACKPACK SYSTEM

BACKGROUND—FIELD OF INVENTION

The present invention relates to backpack systems and, more particularly, to backpack systems which allow freedom of movement to a user.

This backpack is designed for use by campers, hunters, fisherman, climbers, military personnel and the like, who need freedom of movement during their normal activities.

BACKGROUND—DESCRIPTION OF PRIOR ART

Initially people carried heavy loads using rucksacks. This method of carrying loads had some problems. First rucksacks transferred the load through shoulder straps alone. Second the load did not hold its shape. The first major advancement came with the introduction of a rigid frame. This permitted the user to make the load hold its shape and not shift. Consequently people started carrying heavier loads. This led to the next change which was the addition of the waist belt. With a waist belt the bulk of the load is transferred to the user's hips.

When people walk their upper torso and hips move in a very complex manner relative to each other. During a normal stride, a person leans forward, backwards and from side to side in a rhythmic pattern. In addition the upper torso and the arms rotate opposite to the hips and legs in the vertical axis of the spine. This enables the walker to move and maintain balance in a fluid and economical manner.

From the above description of how a person walks, it can be seen that the current use of a rigid frame in conjunction with a waist belt creates a substantially rigid couple between the shoulders and the hips of the user. The motion of the hips relative to the shoulders and twisting or bending of the user's torso is restricted by the rigidity of the pack frame. Accordingly each walking step or motion causes a tugging stress which is transmitted from the hips to the shoulders. It can be very awkward and uncomfortable to the user. Thus the previous frame and waist belt systems destroy balance, restrict movement and cause constant rubbing against the hips and shoulders as the user walks.

In an attempt to make backpacks more comfortable various frames with flexible joints have been developed and added to the waist belt. The following U.S. Pat. Nos. 3,355,075; 4,015,759; 4,189,076; 4,214,685; 4,303,186; 4,369,903; 4,479,595; 4,504,002; and, 4,911,346 are directed to to backpack frames having such a joint. These frames permit free movement of the hip and upper torso to varying degrees. However they create other problems such as increased weight, complex design, higher manufacturing costs, increased load imbalance and additional rotational movement on the shoulder. Some of these advanced designs include complex mechanisms that are easily damaged or destroyed under field conditions.

Another problem or need is the requirement to carry different size loads. The backpacker needs a large pack to accommodate all the equipment and supplies for an extended trip. Once the base camp is reached the backpacker needs a small volume pack for short trips out from the camp. Most backpackers carry a small pack in addition to their main pack to satisfy this need. A backpack system that can be separated into modular elements can satisfy both these needs. Hence a single backpack system that can be separated into a waist pack and a day pack has this flexibility. When the two packs are joined together they make up the large volume expedition pack. Consequently the need to purchase and carry an added pack or packs is eliminated. This invention is directed towards such a modular backpack system.

OBJECTIVES AND ADVANTAGES

The present invention overcomes the above mentioned problems by employing a single three-axes joint which divides the vertical structure of the frame. The joint is designed so that it can be easily separated into modules for better distribution of loads and flexibility of uses. This design allows unrestricted rotation of the user's back about the vertical axis and permits movement in all three directions.

It is therefore a primary objective of the present invention to provide a comfortable riding backpack that does not impede freedom of movement between the user's back and hips.

Still another objective of the present invention is to provide a modular backpack which permits multiple uses by the wearer.

A further objective of the present invention is to provide a backpack frame interconnected with a three-axes joint or joints which can be quickly and easily disconnected.

An additional objective of the present invention is to minimize rotational load on the user's shoulders.

Another objective of the present invention is to provide a backpack for mountain climbers, hikers, skiers and military personnel who must be able to rotate their torsos about any or all three-axes without impediment during the normal course of their activities.

A final objective of this invention is to provide all of the above features without increasing the complexity of the design and the cost of fabrication.

DRAWING FIGURES

REFERENCE NUMBERS IN DRAWINGS

10—internal frame
11—upper vertical members
12—lower vertical members
13—ball joint
14—upper frame
15—upper horizontal member
16—lower horizontal member
17—lower half of ball joint (13)
18—lower frame
19—upper half of ball joint (13)
20—backpack system
21—lower module 22—upper module
23—typical backpack padded pocket, upper
24—typical backpack shoulder harness
25—typical backpack waist belt
28—Typical backpack padded pocket, lower
41—shoulder axis
42—hip axis
43—direction of travel
46—lateral axis

DESCRIPTIONS—FIGS. 1 TO 4

Figure 1:
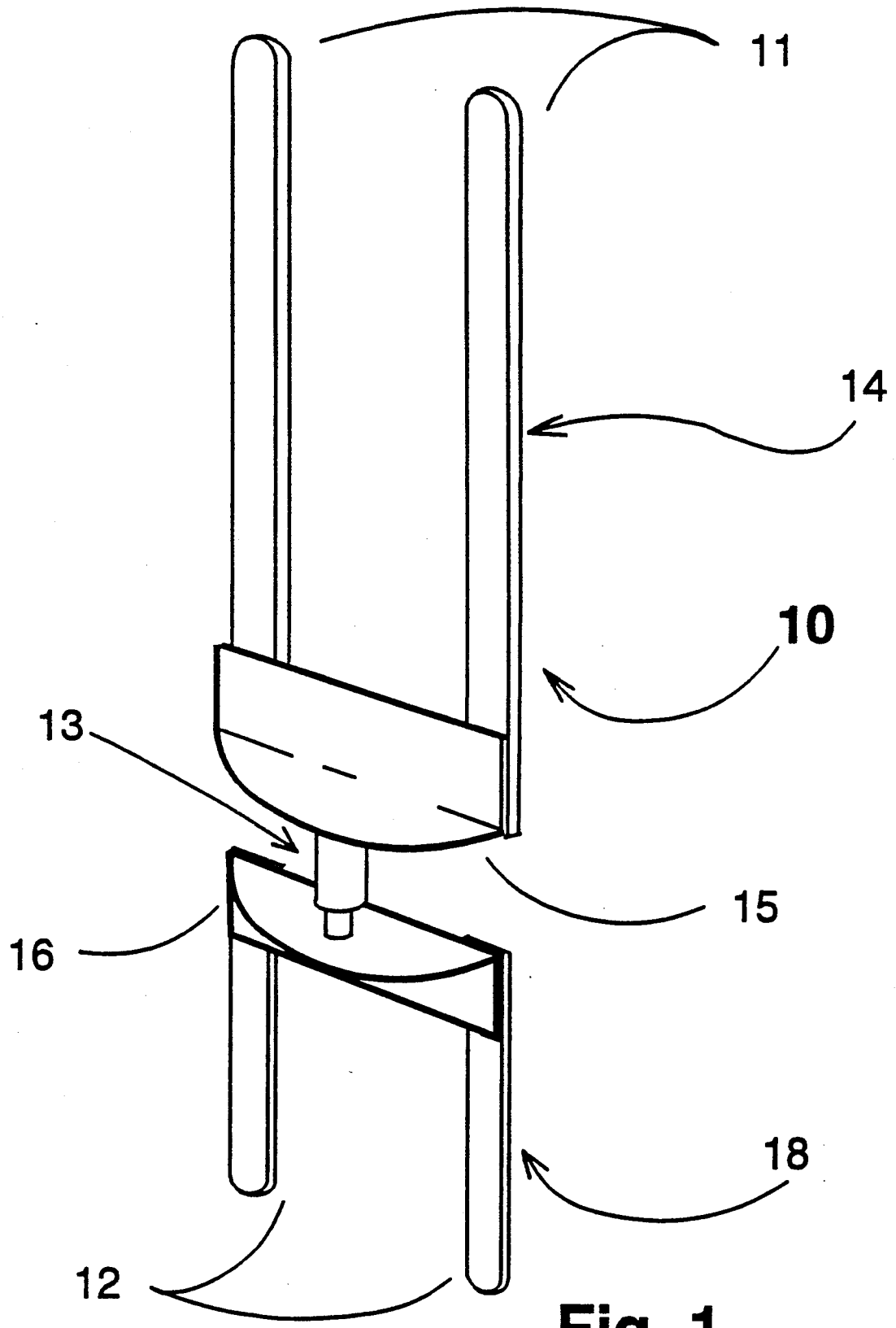
FIG. 1 shows the internal frame embodiment with the upper and lower frames connected by a three-axes ball joint.

FIG. 1 shows an internal frame 10 which is divided into two sections by a ball joint 13. The upper frame 14 is made up of upper vertical members 11 which are connected at their lower end by the upper horizontal member 15. This member serves as a mount for the upper half of the ball joint 19. The lower frame 18 is similar to the upper frame 14 except that it is inverted with lower vertical members 12 connected to the lower horizontal member 16 where the lower half of the ball joint 19 is mounted.

Figure 2:
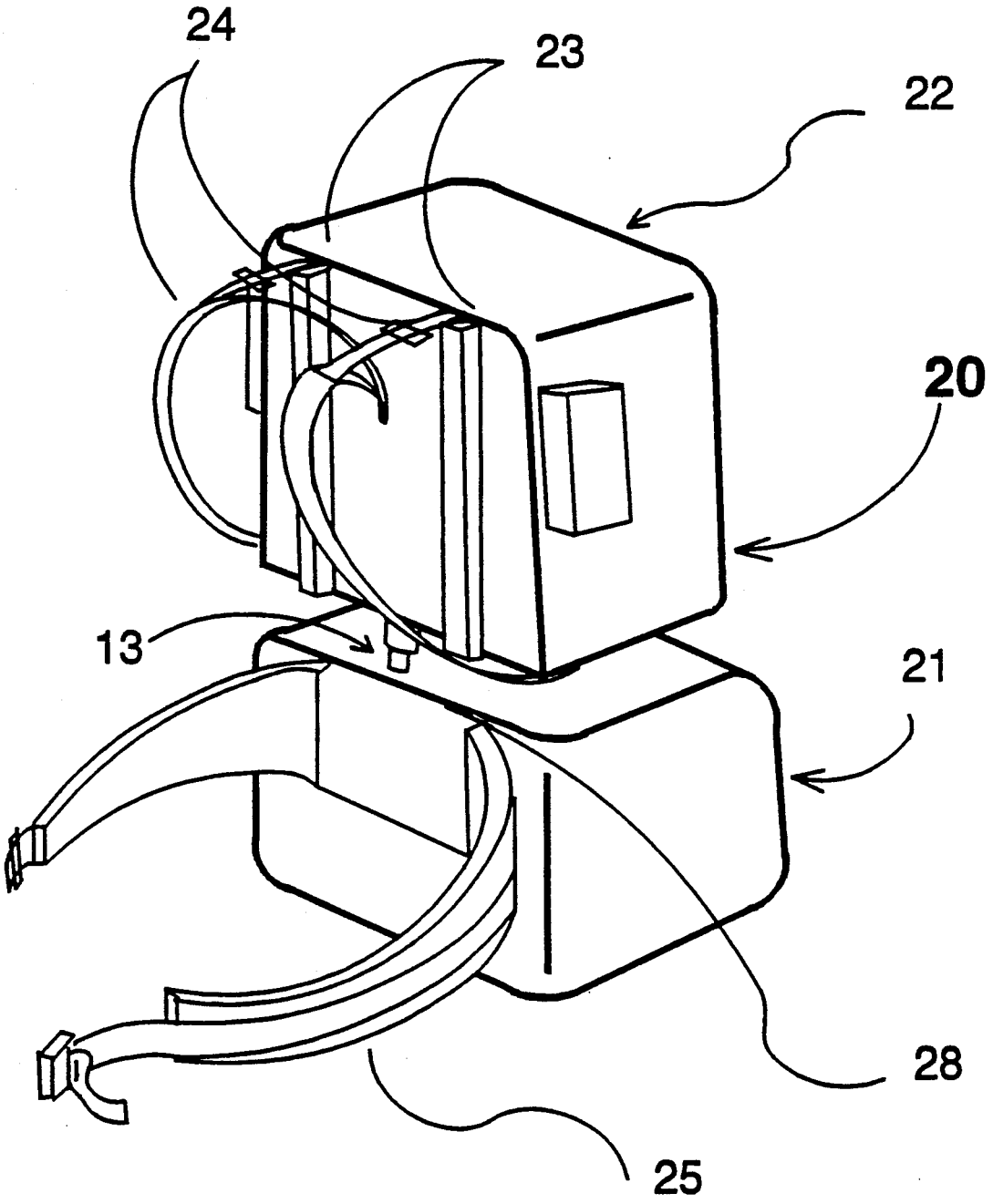
FIG. 2 illustrates the backpack system's upper and lower modules mounted on the internal frame and connected by the three-axes ball joint. Also shown are the shoulder and waist straps.

FIG. 2 shows the lower and upper modules 21 and 22 mounted on the internal frame of FIG. 1 through the use of typical backpack padded pockets 23 and 28. The typical backpack shoulder harness is 24. A typical backpack waist belt is 25. Both 24 and 25 are an integral part of the backpack system as shown in FIG. 2.

The preferred embodiment of the three-axes ball joint 13 is found in patent pending Ser. No. 07/321,173. The joint 13 is shown decoupled in FIG. 3. It comprises a spherical hinge formed by its upper half 19 and its lower half 17. The upper half of the ball joint 19 is mounted on the upper horizontal member 15 shown in FIG. 1. The lower half of the ball joint 17 in mounted on the lower horizontal member 16 as shown in FIG. 1.

Figure 3:
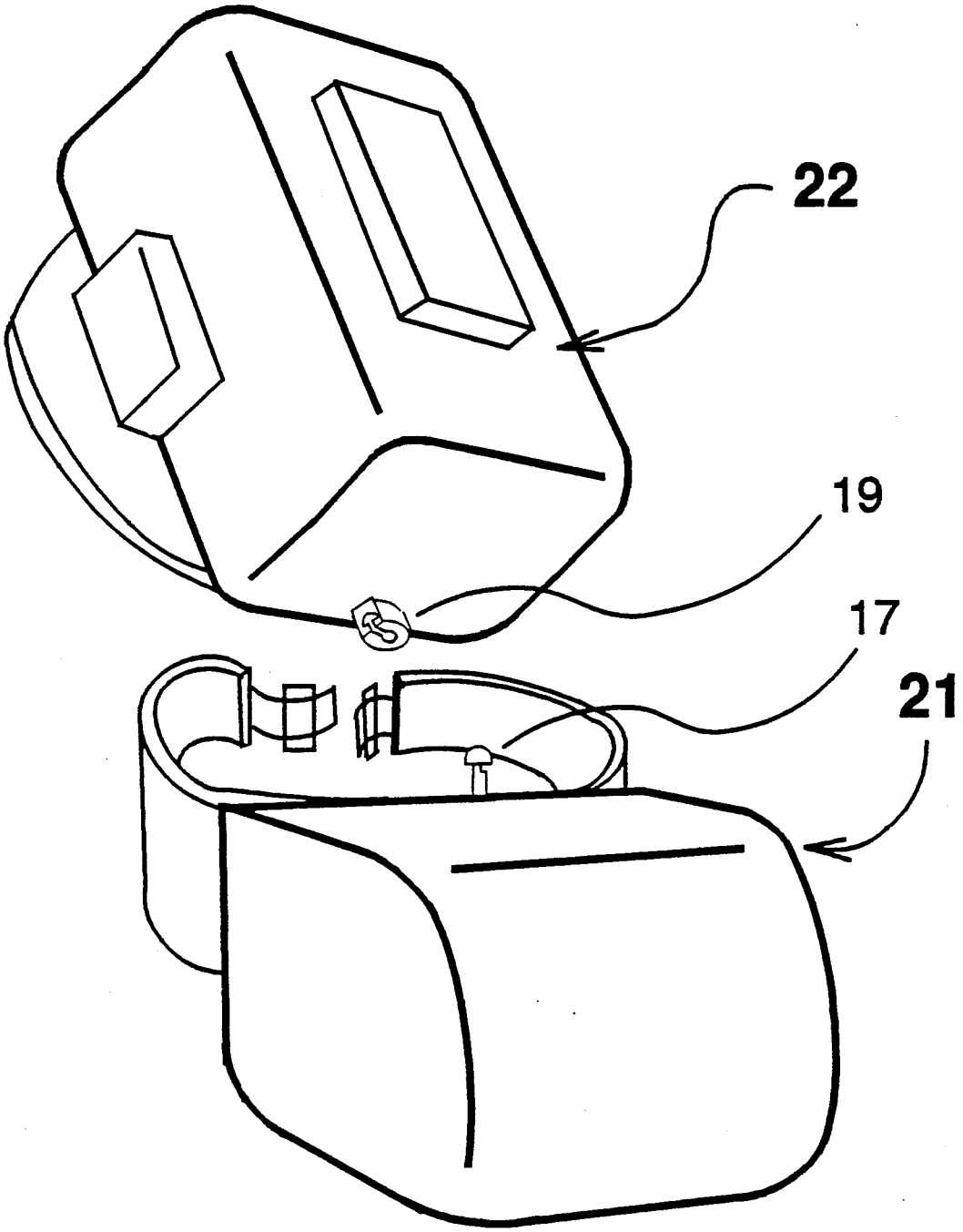
FIG. 3 depicts the upper and lower modules separated by a disconnected three-axes two-piece ball joint.

FIG. 3 shows the backpack separated into two pack modules. The upper module is 22 and the lower module is 21. Also shown in the ball joint 13 after its two halves, upper half 19 and lower half 17, have been detached from each other.

OPERATIONS OF THE INVENTION

Figure 4:
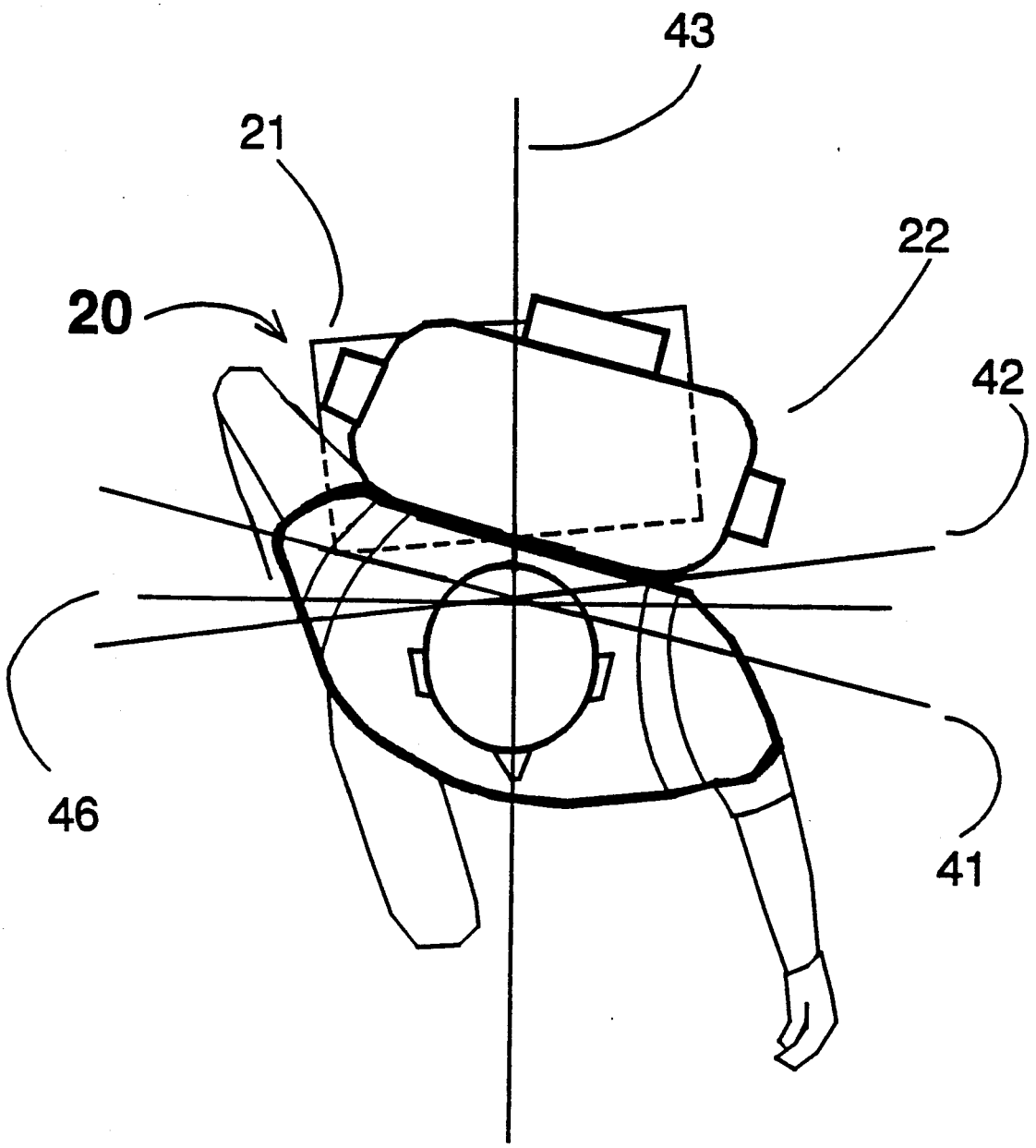
FIG. 4 is a top view of the user wearing the backpack system showing freedom of movement around the vertical axis.

FIG. 4 shows the operation of the modular backpack system 20 with its two elements moving with the user's body movement during normal activities along the direction of travel 43. FIG. 4 depicts the counter rotation of the upper module 22 and the lower module 21 of the backpack system. The backpack system's two joined modules permit the backpack system to move in conjunction with the user's hip axis 42 and the user's shoulder axis 41 during the walking motion.

The operations of the three-axes ball joint including its pivoting and quick release characteristics are described in detail in patent pending Ser. No. 07/321,173.

The modularity of the backpack is depicted in FIG. 3. When the two modules are connected by the ball joint the backpack system can be used as an expedition pack. When the modules are separated, as shown in FIG. 3, the lower module 21 can be used as a waist pack. The upper module 22 can be used as a day pack. This flexibility of design permits the upper and lower modules to be used separately or together depending upon the load requirements of the situation.

SUMMARY, RAMIFICATIONS AND SCOPE

This invention provides a backpack that is flexible, highly reliable, light weight, yet economical to manufacture. The backpack can be used by a person of almost any size or either gender to carry loads.

While the above description contains many specifications, these specifications should not be construed as limitations on the scope of the invention, but rather an example of the preferred embodiments. Many other variations are possible. For example the use of multiple joints, different locations for the joint in a one joint system, use of other types of three-axes pivots, use of frames, packs, and joints made of different materials. Accordingly the scope of the invention should be determined not by the embodiment(s) illustrated but by the appended claims and their legal equivalents.

We claim:

1. A backpack system comprising: an upper module and a lower module wherein said modules are detachably connected by a three axes ball joint assembly which permits independent movement of said upper and lower modules, said upper module having an upper frame and an upper container, said upper frame including two substantially parallel upper vertical support members connected at one end by an upper horizontal member, wherein said upper horizontal member provides an upper means for mounting a portion of said ball joint assembly, said upper container including a backpack shoulder harness connected to an upper bag having two upper backpack parallel padded pockets for receiving and retaining said vertical support members of said upper frame, said lower module having a lower frame and a lower container, said lower frame including two substantially parallel lower vertical support members connected at one end by a lower horizontal member, wherein said lower horizontal member provides a lower means for mounting another portion of said ball joint assembly, and said lower container comprising a backpack waist belt attached to a lower bag, having two lower backpack parallel padded pockets for receiving and retaining said vertical support members of said lower frame, wherein said ball joint assembly provides a means for detachably connecting said upper and said lower modules such that said upper and lower modules can be independently worn by a user.

2. The backpack system in claim 1, where in said upper and said lower frame units are of an external configuration.

3. The backpack system in claim 1, wherein a ball of said ball joint assembly is an integral part of said lower frame unit, and a socket of said ball joint assembly is an integral part of said upper frame unit.

4. The backpack system in claim 1, wherein said frames are an integral part of said upper and said lower container modules.

5. The backpack system in claim 1, wherein said ball joint assembly is aligned on a user's back with the user's spine.

* * * * *